US010779663B2

(12) United States Patent
Hagiage et al.

(10) Patent No.: US 10,779,663 B2
(45) Date of Patent: Sep. 22, 2020

(54) DISPENSER FOR SUPPORTS TO BE IMPREGNATED WITH AN ODOUR

(71) Applicant: GAUDIER KUPPEL GROUP SARL, La Courneuve (FR)

(72) Inventors: Marc Hagiage, La Courneuve (FR); Laurence Leveque, Paris (FR); Guillaume Serre, Epinay sur Seine (FR)

(73) Assignee: GAUDIER KUPPEL GROUP SARL, La Courneuve (FR)

( * ) Notice: Subject to any disclaimer, the term of this patent is extended or adjusted under 35 U.S.C. 154(b) by 0 days.

(21) Appl. No.: 15/565,763

(22) PCT Filed: Apr. 11, 2016

(86) PCT No.: PCT/EP2016/057901
§ 371 (c)(1),
(2) Date: Oct. 11, 2017

(87) PCT Pub. No.: WO2016/166051
PCT Pub. Date: Oct. 20, 2016

(65) Prior Publication Data

US 2018/0116428 A1 May 3, 2018

(30) Foreign Application Priority Data

Apr. 13, 2015 (FR) ..... 15 53190
Dec. 23, 2015 (FR) ..... 15 02687

(51) Int. Cl.
*B65H 1/06* (2006.01)
*B05B 11/00* (2006.01)
(Continued)

(52) U.S. Cl.
CPC ..... *A47F 7/286* (2013.01); *A45D 40/0087* (2013.01); *B05B 11/30* (2013.01);
(Continued)

(58) Field of Classification Search
CPC ..... A47F 7/286; B05B 11/30; B05B 13/0221; B05B 13/0242; B65D 83/0805; B65H 1/06; B65H 1/266; B65H 3/06
(Continued)

(56) References Cited

U.S. PATENT DOCUMENTS 5,018,614 A * 5/1991 Ruckert ..... B65H 3/042 194/236
5,225,665 A * 7/1993 Zerfahs ..... G07B 15/02 235/384
(Continued)

FOREIGN PATENT DOCUMENTS

DE 19938405 * 2/2001 ..... B05B 12/02
FR 2987761 9/2013

*Primary Examiner* — Rakesh Kumar
(74) *Attorney, Agent, or Firm* — Duane Morris LLP; Gregory M. Lefkowitz; Jason M. Nolan

(57) ABSTRACT

The invention relates to a machine for dispensing perfume-testing supports, comprising support storage means for storing a batch of supports, support-dispensing means for transporting the supports one by one to a delivery point, and support impregnation means for depositing a perfume sample on each dispensed support, before the dispensing thereof. The dispensing means comprise support-marking means for marking each dispensed support at the moment of the dispensing thereof, the marking means and the impregnation means being automatically actuated during the dispensing process.

15 Claims, 7 Drawing Sheets

(51) Int. Cl.

| | |
|---|---|
| ***A47F 7/28*** | (2006.01) |
| ***A45D 40/00*** | (2006.01) |
| ***B65H 1/26*** | (2006.01) |
| ***B65H 3/06*** | (2006.01) |
| ***B05B 13/02*** | (2006.01) |
| ***B65D 83/08*** | (2006.01) |
| ***B65H 3/04*** | (2006.01) |
| ***B05B 12/00*** | (2018.01) |
| ***B65H 1/12*** | (2006.01) |

(52) U.S. Cl.
CPC ..... *B05B 12/004* (2013.01); *B05B 13/0221* (2013.01); *B05B 13/0242* (2013.01); *B65D 83/0805* (2013.01); *B65H 1/06* (2013.01); *B65H 1/12* (2013.01); *B65H 1/266* (2013.01); *B65H 3/042* (2013.01); *B65H 3/06* (2013.01); *B05B 11/00* (2013.01); *B65H 2701/193* (2013.01); *B65H 2701/1914* (2013.01)

(58) Field of Classification Search
USPC ..... 221/135
See application file for complete search history.

(56) References Cited

U.S. PATENT DOCUMENTS

| | | | | | |
|---|---|---|---|---|---|
| 5,335,822 | A * | 8/1994 | Kasper | B65H 3/24 | 221/198 |
| 5,848,727 | A * | 12/1998 | Leo | B65H 3/0638 | 221/259 |
| 6,637,620 | B2 * | 10/2003 | Oshinsky | A47F 7/286 | 221/135 |
| 6,698,614 | B2 * | 3/2004 | Snead | G07B 3/04 | 221/135 |
| 8,546,301 | B2 * | 10/2013 | Ribi | B41M 5/38214 | 503/226 |
| 2002/0020717 | A1 * | 2/2002 | De Laforcade | B65D 83/22 | 222/321.8 |
| 2002/0158076 | A1 * | 10/2002 | Snead | G07B 3/04 | 221/33 |
| 2008/0202362 | A1 * | 8/2008 | Stravitz | B26D 5/10 | 101/6 |
| 2018/0116428 | A1 * | 5/2018 | Hagiage | B65H 1/12 | |

* cited by examiner

DISPENSER FOR SUPPORTS TO BE IMPREGNATED WITH AN ODOUR

CROSS-REFERENCE TO RELATED APPLICATIONS

This application is a § 371 national stage entry of International Application No. PCT/EP2016/057901, filed Apr. 11, 2016, which claims priority to French Patent Application No. 1553190, filed Apr. 13, 2015, and French Patent Application No. 1502687, filed Dec. 23, 2015, the entire contents of which are incorporated herein by reference.

The scope of the invention is that of a perfume, an aroma, a bouquet, a scent, a fragrance, an odour being selected by a person, with the aim of purchasing a small bottle or a bottle of perfume, eau de toilette, a tube or a box of cosmetic cream, or even a culinary dish or a drink. This selection is generally made, concerning perfumery products, using supports called "strips", or "rollers", made from paper, tissue, or other similar material. The selection of a perfume is often made using small presentation bottles and strips. A person sprays a bit of perfume from a small bottle to impregnate a strip with it, that they will then sniff.

This selection method has several disadvantages. The selection supports are commonly stored in a glass or container, not very suitable, as could be knocked over, and the strips are left there with no protection. The small selection bottles used can be used excessively, and the result of this a high consumption, a need for a regular resupply and an overloading of space. And in particular, it can prove to be difficult, after several selections of different perfumes, to truly identify the perfumes tested on the different strips used.

There are already machines which enable at least some of these problems to be avoided. For example, the document US2002/0020717 defines one of them, which enables a dose of perfume to be dispensed onto a test strip which is inserted manually into an opening of the machine, then removed. The machine contains a pump with a spray nozzle, whereon a control arm, actuated by a strip support plate, is pressed to bring about the spraying on the strip when this and its support plate are pushed in the machine. This machine enables the small selection bottles to be managed more easily and enables an overconsumption of perfume to be avoided in particular because a lock, which released only if a strip is inserted in the machine, prevents spraying in the event where the strip support plate is pushed without a strip being delivered there. An advantage is that this machine is simply actuated by the user when they push the strip and its support in the machine. But it requires the delivery of strips outside of the machine, which does not solve the problem of storing and presenting said strips, nor that of identifying the strips after several selections of different perfumes.

The document U.S. Pat. No. 6,637,620 defines another equipment enabling to dispense the strips impregnated with perfume. This equipment comprises a case containing a stock of strips which can be supplied one by one by means of a drive system, actuated by an external handle, which delivers the strip through a slot in the case. Furthermore, the actuation of the handle brings about, by the intermediary of a rack-and-pinion system acting on a perfume dispensing pump, the spraying of the perfume on the strip before this cannot be removed from the case by the user. This equipment therefore ensures the storage and preservation of selection strips before they are used, and also avoids an excessive consumption of perfume. But its use requires a handling of the handle. Furthermore, except for previously individualising the strips for each dispensing equipment, which highly complicates their management, the identification problem after several selections of different perfumes persists, insofar as nothing enables the strips to be distinguished after they have been removed from the different equipment used.

This invention aims to solve the problems mentioned above, and aims in particular to enable a dispensing of selection supports, without the user needing to handle a handle or other control body. It also aims to enable a significant storage capacity for selection supports, avoiding the need for frequent replenishment. The machine according to the invention must also enable a direct identification of the perfume used, enabling a replacement of the small bottle and a refilling of the supports. It must be easily accessible visually on a table, shelf displays, walls, columns or any other means which could contain it or support it, enabling a selection bar or piano to be created, for example, while protecting the small bottles presented. By avoiding excessive uses of perfume, it also aims to save on small selection bottles.

Thus, the invention aims for a machine for dispensing support means intended to be impregnated with at least one odour to be selected, comprising means for storing the support means, means for dispensing the support means and delivery to a person, means for receiving means for emanating odour, means for impregnating the odour support means to be selected, characterised by the fact that the dispensing and delivery means comprise matching means i) of the impregnated support means and ii) of the odour to be selected.

Advantageously, the means for the emanating odour to be selected comprise a small selection perfume bottle or a plurality of these small bottles and the support means intended to be impregnated with the odour comprise a plurality of individual strips or a large strip pre-cut into strips or strip sections to be detached from each other.

Preferably, the means for matching the support means and odours to be selected comprise means for marking the support means and the impregnation means are arranged to be actuated automatically or mechanically.

Thus, the machine according to the invention enables to ensure a sustainable identification, by matching the strip and the odour impregnated on it.

According to a preferable provision, the marking means comprise embossing means. The marking could also be obtained by printing, for example, an ink print, but marking by embossing, in other words, a simple print of an elevation, enables avoiding the use of printing inks on the strip, in particular if the bands are made from a porous material such as absorbent paper, for example.

According to another specific provision, the marking means comprise a set of two marking rollers between which the strip passes during dispensing. The marking is made therefore just before the strip is made available to the user, when they retrieve the strip from the machine.

According to a preferable provision, the machine comprises an integrated small bottle support, to place a small perfume bottle to be tested there, and the impregnation means comprise a pump connected, on the one hand, to the small bottle and, on the other hand, to a spraying nozzle located on the trajectory of the strips between the storage means and the marking means. Preferably still, the pump is actuated by a lever connected to the strip dispensing means, so as to ensure one single spray on each strip, before the strip impregnated with perfume passes into the marking means and is retrieved from the machine.

According to a preferred embodiment, which does not require any external energy source, nor any mechanical control means, such as, for example, the handle of the prior system defined previously, the dispensing means comprise drive pulleys arranged to be driven by a dispensed strip when the strip is retrieved manually from the machine, the drive pulleys being connected to a drive mechanism arranged to bring the strips retrieved one by one from the means for storing strips up into the marking roller grip.

Preferably, the drive pulleys are connected in rotation to the marking rollers, for example, by being assembled on the same rotating shafts, and the two shafts, each one holding two drive pulleys surrounding a marking roller, are connected in rotation in the opposite direction, by sprockets, also assembled on said shafts. When the strip is retrieved from the machine, by the traction exerted on it by the user, a simultaneous and synchronised drive is thus ensured of the rollers and marking rollers, guaranteeing the quality of the embossing.

According to a further provision, the drive mechanism comprises:

- transportation bodies arranged so as to retrieve a strip located against a bottom of the storage means by friction, and to transport this strip up into the marking means grip and
- an alternative drive mechanism to drive the transportation bodies alternatively:
- in a first phase, by the drive pulleys when these are driven in rotation by retrieving a strip,
- in a second phase, by energy storage means arranged to store energy during the first phase.

In particular, the energy storage means can comprise a spring acting on a rack meshing with the sprockets connected to the transportation bodies in a temporarily separable way, enabling the storage of energy to be ensured in the first phase and the return of energy in the second phase, while ensuring the movement of the transportation bodies in the same direction during these two phases.

According to other further provisions:

- the machine comprises a control case connected to the detection means for detecting the replacement of a small bottle, to the means for counting the actuation number of the impregnation means and to the means for detecting the presence of strips in the storage means, the control case moreover comprising indication means, and
- means for detecting the small bottle replacement comprise electric contact means held by the small bottle support and connected to the control case.

These detection and control means enable to indicate when the small bottle must be replaced and when the stock of strips must be replenished. In particular, this system can be based on a reset when the small bottle is replaced and/or when a batch of strips is replaced in the container, and the indication being activated after a certain number of uses, in other words, strips used and sprays carried out, this number being predetermined according to the number of strips which could be contained in the container and the volume of perfume contained in the small bottle.

According to other provisions still, the machine comprises a closed case, inside which the strip storage means, the dispensing means, the small bottle support means and the impregnation means are located, the case comprising one single opening for communicating with the outside, constituted by a slot arranged in a wall of the case opposite the marking means, to enable the passage of dispensed strips. Thus, in the point of sale, the end of the strip that the user can grip to test the perfume contained in the small bottle is only accessible by the slot, without the small perfume bottle itself or the stock of test strips being directly accessible.

Furthermore, the perfume contained in the machine can advantageously be identified, in an attractive way, by a small perfume selection bottle presented in a window on top of the case, enabling to showcase the product tested. This window will advantageously be integrated in a regular volume of the case, for example, of cubic form, the whole machine thus having regular forms adapted to display stands or shelves.

Generally, the machine according to the invention enables to ensure the management of a stock of testers and their automatic dispensing, the management of the impregnation and the printing of a mark enabling to identify the perfume tested.

Other characteristics and advantages will appear in the description which will be made of a dispenser that conforms with the invention, as well as its functioning, in reference to the appended drawings, whereon:

Figure 15:
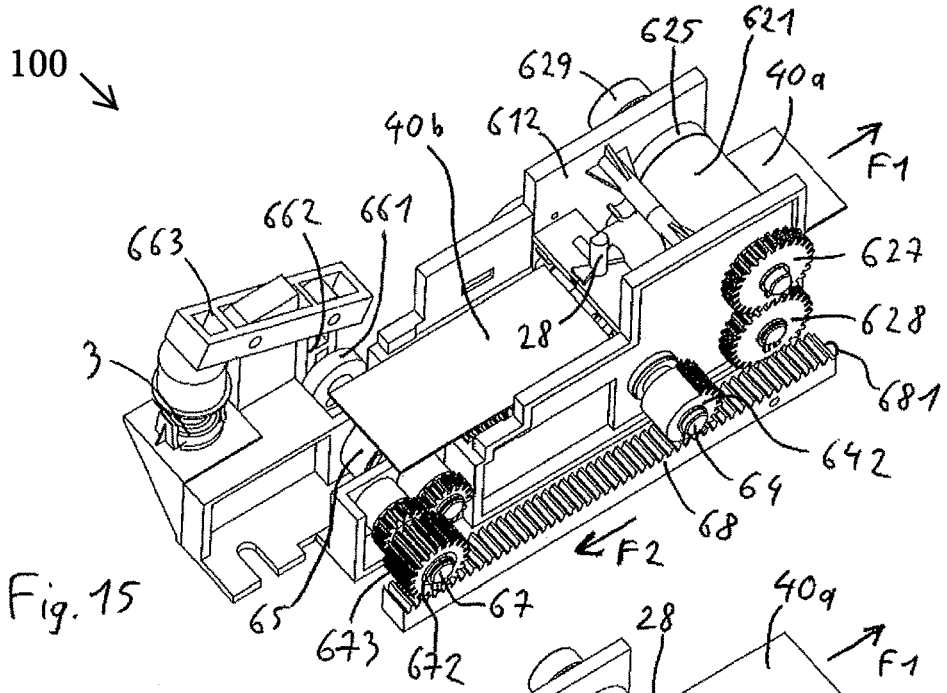
Figure 16:
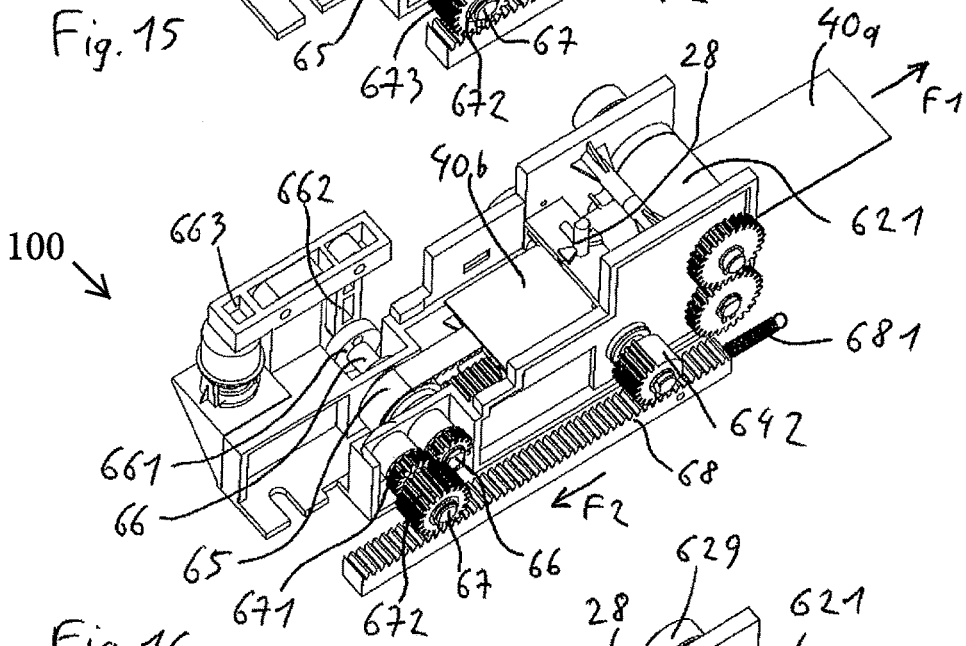
Figure 17:
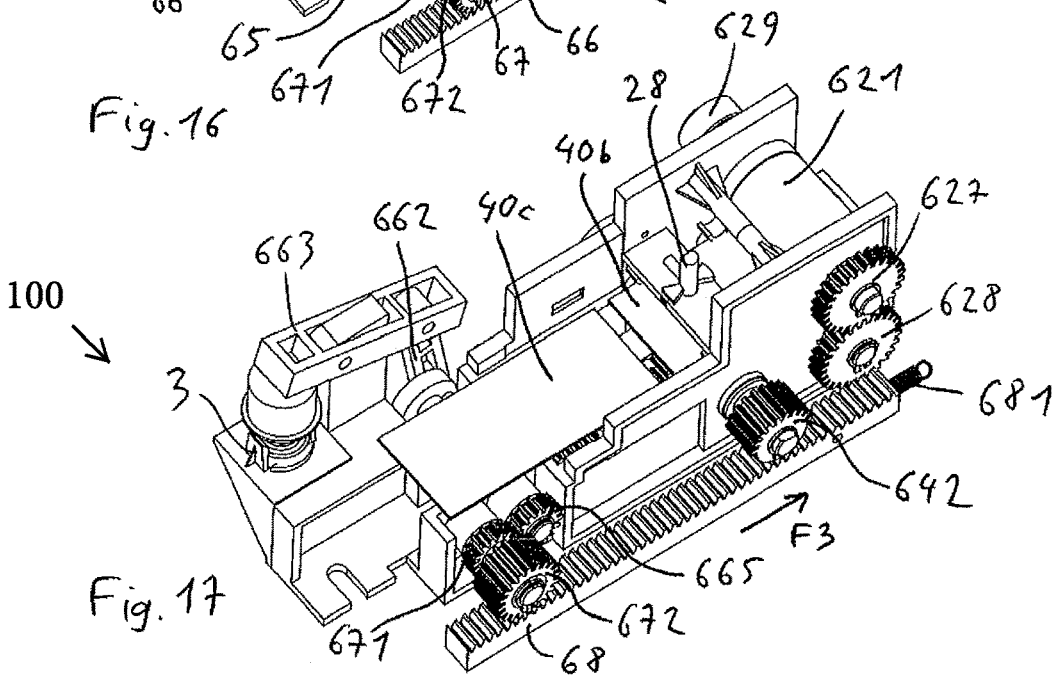

FIGS. 15 to 17 only illustrate the drive mechanism, in three different phases of supplying strips.

Figure 1:
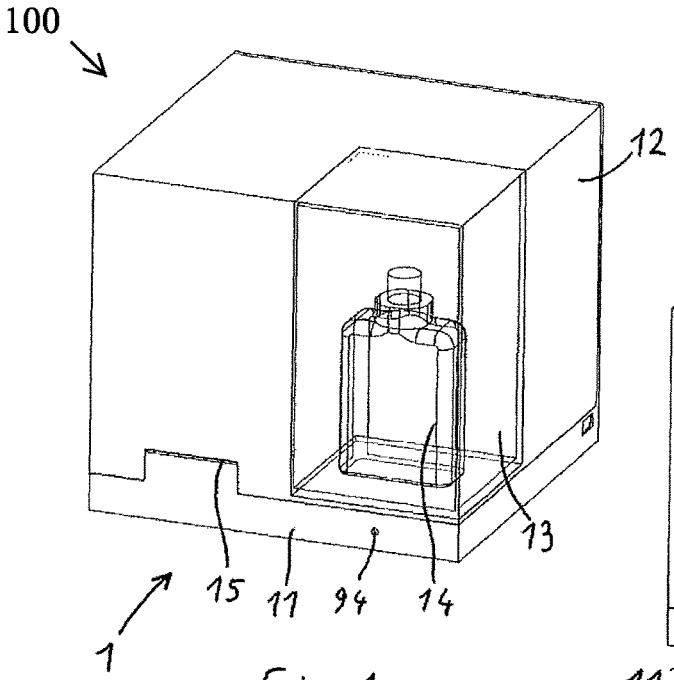
FIG. 1 is a perspective view of the machine that conforms with the invention, in a situation of use.
Figure 2:
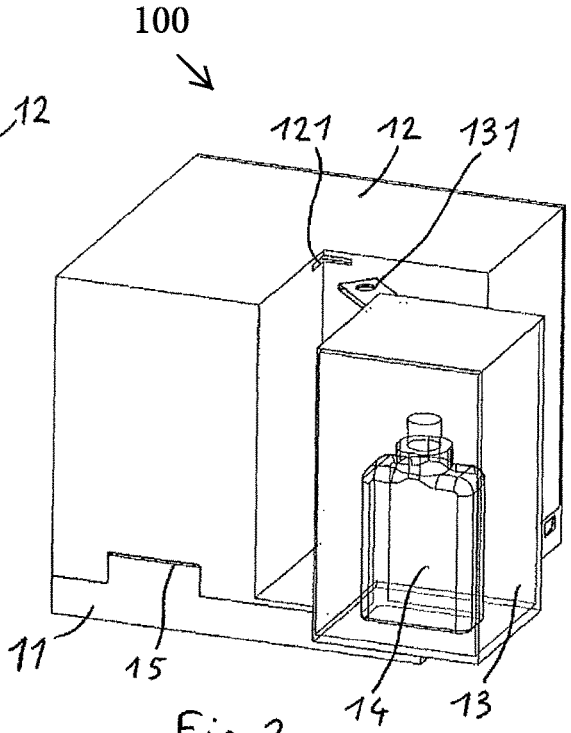
FIG. 2 is a similar view, showing the separate window of the main case.

The dispenser 100, such as represented in FIG. 1, comprises a case 1 in a general cubic or parallelepipedic form, for example, around 150 to 200 mm on the side. This case comprises a bottom 11 serving as a frame for supporting the different subassemblies and functional bodies of the machine 100. It ensures the positioning of the different mechanisms inside the dispenser 100, while guaranteeing its placement, in particular on perfumery displays. The dispenser comprises a lid 12, here made from an opaque plastic material, which conceals the internal mechanism and isolates it from users, while ensuring the aesthetic part of the dispenser 100. An angle of the cube is occupied by a window 13 made from transparent material enabling to view the product to be selected and to be tested, here a small perfume bottle 14, to showcase it. The window is held on the lid by a tab 131 which can be locked on the lid by insertion into a slot 121 of it.

Inside the case 1, a spraying unit 2 comprising a small bottle support 21, connected to a perfume spraying pump 3, a strip storage container 4, a dispensing mechanism 6 and an electric control case 9 are arranged.

The small bottle support 21 comprises a base 22, provided with a level 23 comprising a vertical notch 231. A top flange 24 is slid onto the level and holds a lock 241 which cooperates with the notches of the level. This arrangement is provided so that the flange 24 can permanently press onto a connector 25 arranged to be adapted on the small bottle 20 containing the test perfume, and whereon is connected, moreover, a first suction tube 26, itself connected to the pump 3, of which the actuation will be defined below. The pump 3 is moreover connected by a second tube 27 to a spraying nozzle 28 attached onto the frame 61 of the dispensing mechanism 6.

The connector 25 is indeed similar to a closing and spraying cap, adaptable on a common small bottle, whereon the tube 26 is connected and whereon it is placed on the conventional nozzle of the small bottle, after it is replaced. The locking of the top flange 24 enables to hold the small bottle surrounded between the base 22 and the flange 24, by also holding the pressed connector, in a position adapted for enabling the passage of the perfume from the small bottle 20 up to the pump 3.

The base 22 moreover holds a magnet 221 on its bottom face, provided to ensure the holding of the base on the bottom 11 of the case, and a contact tongue 222 arranged to ensure an electric connection between two contact strips 91 extending over the bottom 11 and connected to the electric case 9, when the small bottle support 21 and said electric case are in place. This system enables to supply a signal to the electric case 9, when the small bottle support 21 is repositioned on the bottom 11 of the case, after a replacement of the small bottle 20 held by this support.

Figure 11:
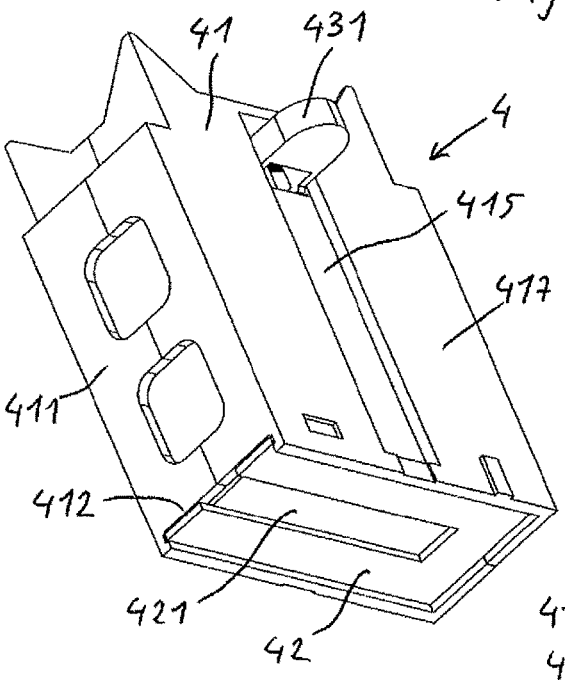
FIG. 11 is a perspective view, from below, of only the stock of strips.
Figure 12:
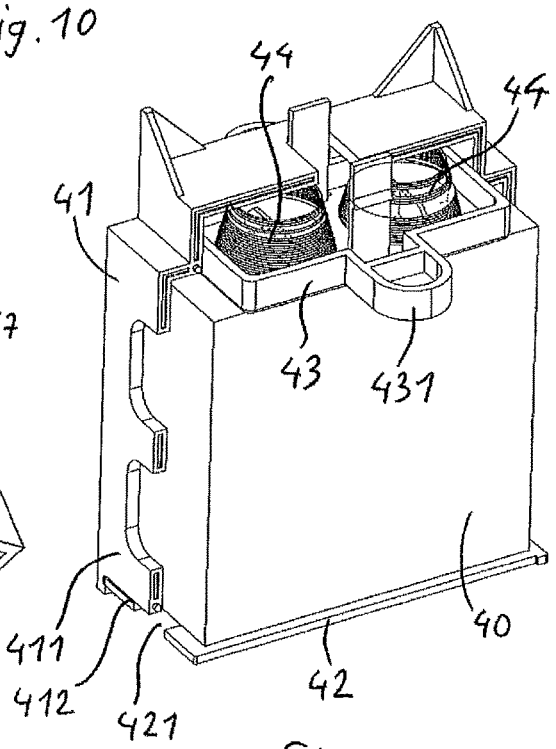
FIG. 12 is a perspective view, from below and cross-section, of only the stock of strips, showing the batch of strips located inside.
Figure 13:
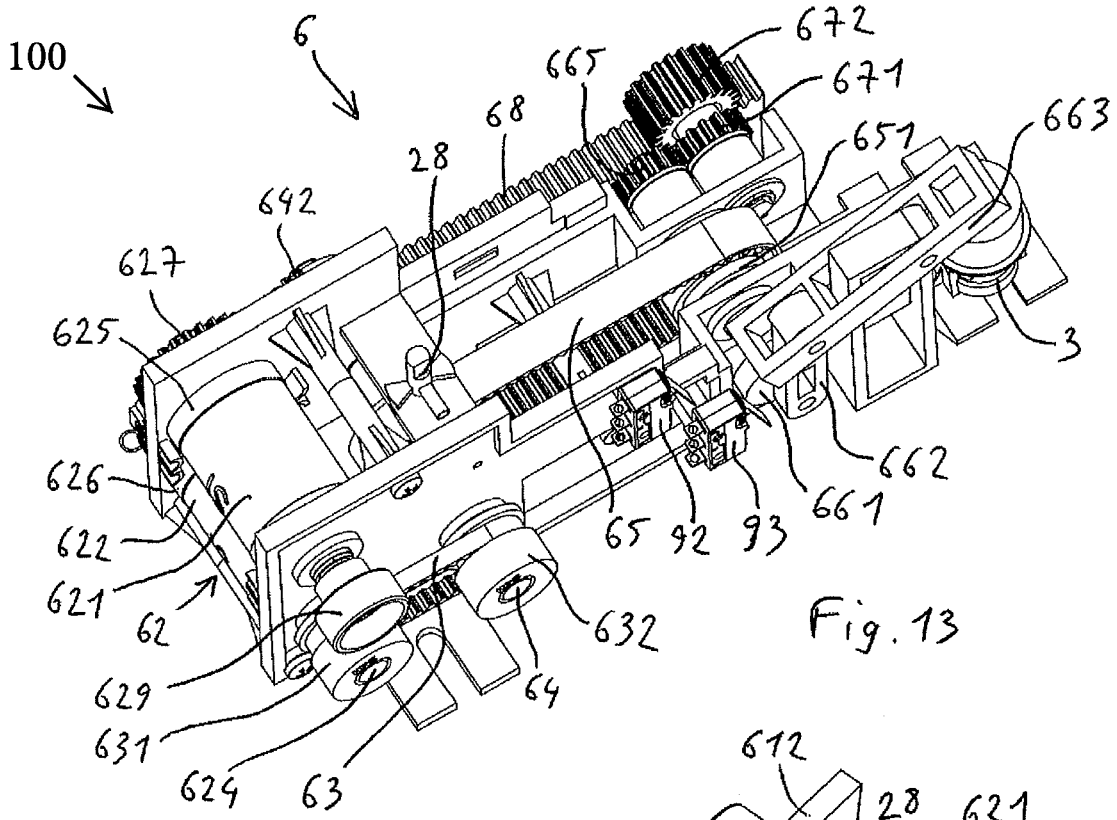
FIG. 13 is a perspective view of only the drive mechanism.
Figure 14:
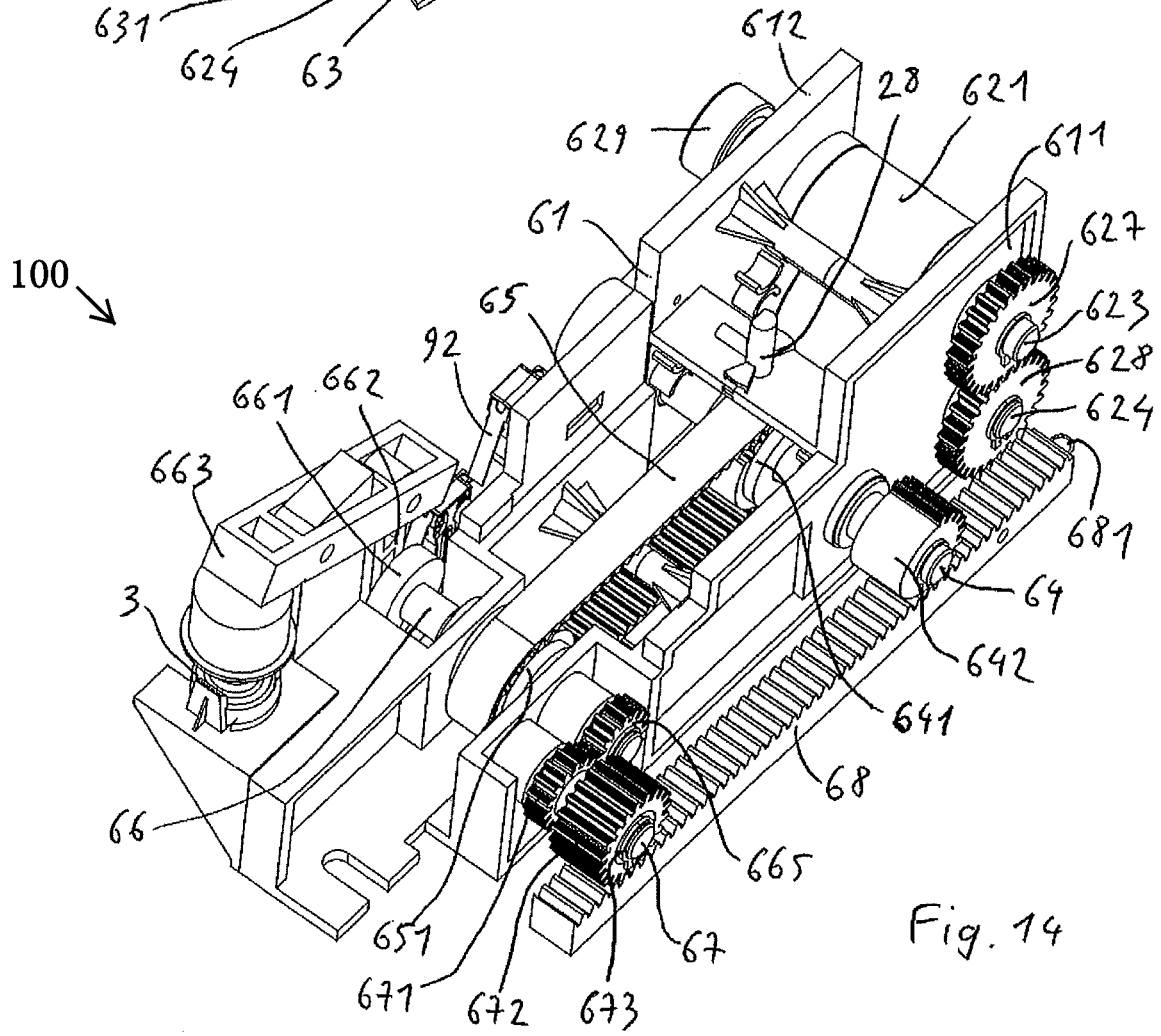
FIG. 14 is a perspective view of only the drive mechanism, according to another view angle.

The container 4 for storing strips, represented in FIGS. 11 and 12, is typically adapted for containing, for example, 200 strips 40, having a format of 82×28 mm, for example. It comprises a container body 41 closed on its bottom part by a bottom wall 42 comprising a retrieval cut-out 421 and arranging in a front wall 411 a retrieval window 412 just above the bottom wall. The bottom wall is sliding to enable access to the inside of the container, to refill it with a batch of new strips. A pressure plate 43 is assembled sliding into the container, pressed towards the bottom by the springs 44 to press the batch of strips towards the bottom wall, and holds the lateral tabs 431, 432 guided into the vertical windows 415, 416 arranged in the lateral walls 417 of the body. One of these tabs 431 is intended to actuate a contactor 92 when the pressure plate 43 gets to the end of the bottom run, to thus indicate that there are no more than a few strips left, and that the container must be refilled.

The container 4 is held attached by clipping onto the frame 61 of the dispenser mechanism 6, in a position determined to enable the retrieval of strips by the dispenser mechanism, as will now be seen.

The dispenser mechanism 6 here comprises, held by this frame 61, a matching unit, here a printing unit, 62 constituted by two embossing rollers with parallel axes, comprising a top roller 621 and a bottom roller 622, which hold the print of the mark to be printed, elevated on the strips. The rollers are respectively assembled on a top drive shaft 623 and a bottom drive shaft 624 with which they are connected in rotation, for example, by keying. The centre of the rollers 621, 622, and therefore these shafts 623, 624, is predetermined, according to the diameter of the rollers and the thickness of the strips 40, to form a grip 620 between the rollers specific to ensure the elevated printing, or embossing, of the strips when they pass between the rollers 621, 622.

The bottom and top drive shafts are assembled rotating in the levels arranged on the lateral flanges 611, 612 of the frame 61, the distance between the flanges being slightly more than the width of the strips 40. On each side, axially, each one of these rollers, between the rollers and the flanges, are assembled the drive pulleys 625, 626, also connected in rotation with the bottom and top transmission shafts and specific to ensure the rotating drive of these shafts by friction with a strip when such a strip located in the grip 620 between the rollers and the pulleys, is retrieved from the dispenser 100, as will be seen below. It will be noted that it is the rotating drive of the pulleys 625, 626, by friction with the strip 40 which ensures the rotation of the drive shafts 623, 624 and therefore the rollers 621, 622, which avoids any inappropriate sliding, which could take place between the strip and the rollers, and which would be damaging to the printing carried out on the strips.

The two bottom and top drive shafts are further connected in rotation, in opposite directions, by a set of synchronising sprockets 627, 628, also assembled connected in rotation on one of the ends of said shafts, which enables to ensure a perfect synchronisation between the embossing rollers, and therefore to guarantee the quality of the printing carried out on the strips.

On the opposite side to the synchronisation wheels 627, 628, a roller 629 is assembled on the end of the top drive shaft 623, to enable the manual driving of the rollers during the first commissioning, or in the event where the strip would no longer have been supplied from the container, to insert a strip between the rollers.

The bottom drive shaft 624 also holds, on the opposite side of the synchronisation pulleys 625, 626, a notched pulley 631 connected by a first notched belt 63 to a second notched pulley 632 of the same diameter, held by a front transmission shaft 64 assembled in rotation on the frame 61 at the back of the printing unit 62. The front transmission shaft 64 is driven in synchronisation with the rollers 621, 622 and the pulleys 625, 626.

The front transmission shaft 64 holds, centred between the two frame flanges, a front notched pulley 641, connected in rotation with said shaft 64 and whereon a second notched belt passes 65 ensuring the connection with a rear notched pulley 651 assembled connected in rotation on a rear shaft 66 called an impregnation shaft.

The second notched belt 65 also serves to retrieve the strips 40 from the container 4 by friction. To this end, the second belt 65 is arranged so that its rear part extends under the container 4, so that its top strand 651 is moved in the retrieval cut-out 421 formed in the bottom sliding wall 42, along this cut-out, and the bottom strip from the stack of strips presses on this strand, to be driven outside of the container when the second belt 65 moves.

The front notched pulley 641 and the rear notched pulley 651 have the same diameter, determined so that the diameter measured on the external face of the second notched belt 65, to the right of one of the notched pulleys, is equal to or slightly larger than that of the rollers 621, 622 and of the pulleys 625, 626, so as to ensure the supply of a strip in the grip 620 of the rollers each time the wheels and rollers turn.

The impregnation shaft 66 holds a handle 661 at one end, driving a crank 662 connected to a pivoting lever 663 which actuates the pump 3. Thus, each time the impregnation shaft 66 turns, the pump 3 sends a small quantity of perfume to the spraying nozzle 28. Furthermore, the handle 661 actuates a contactor 93 on each turn.

The impregnation shaft 66 also holds, on its end opposite to the handle 661, a first pinion 665 which meshes with a second pinion 671 held by a secondary shaft 67 which also holds a rear sprocket 672. The rear sprocket 672 is assembled on the secondary shaft 67 by the intermediary of a free wheel system 673, ensuring a connection in rotation between the rear sprocket and the secondary shaft in one single rotating direction. Moreover, the rear sprocket 672 meshes with a rack 68 which extends longitudinally over the side of the frame 61 and which is pulled back towards the front of the device by a spring 681.

The transmission shaft holds, on its end opposite to the notched pulley 632, a partial sprocket 642, of the same pitch diameter as the rear sprocket 672, which could also mesh with the rack 68. The gearing of the partial sprocket 642 extends over around half of its circumference and is arranged to mesh with the rack 68 over only a half-turn.

The contactors 92 and 93 are connected to the electric case 9. The electric case 9 moreover comprises a small calculator supplied on an internal battery arranged to determine the volume of perfume remaining in the small bottle 220 according to the number of pushes sent by the sensor 93 from the contact established between two contact strips 91 by the contact tongue 222, and according to the volume of the small bottle 20 and the quantity of perfume dispensed by each actuation of the pump 3, and to indicate the need to replace the small bottle 20, by means of an indicator light 94 that can be seen at the front of the case 1. The indicator light 94 also indicates the need to replace the container with strips 4, in response to the signal supplied by the contactor 92.

The presence of a slot 15 located just opposite the grip 620 between the rollers 621, 622 on the front of the case 1 will also be noted, for the passage of the strips 20.

The functioning of the dispenser 100 will now be defined.

Figure 3:
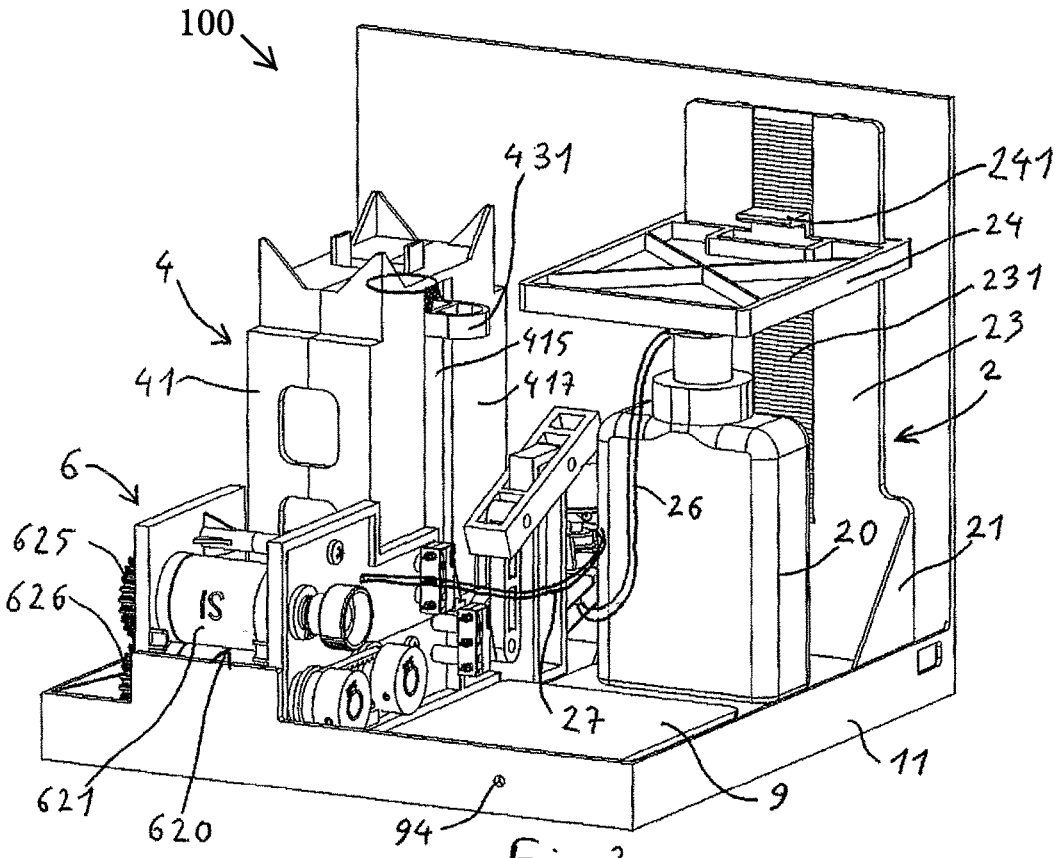
FIG. 3 is a view of the whole of the inside of the machine, after depositing the lid.
Figure 4:
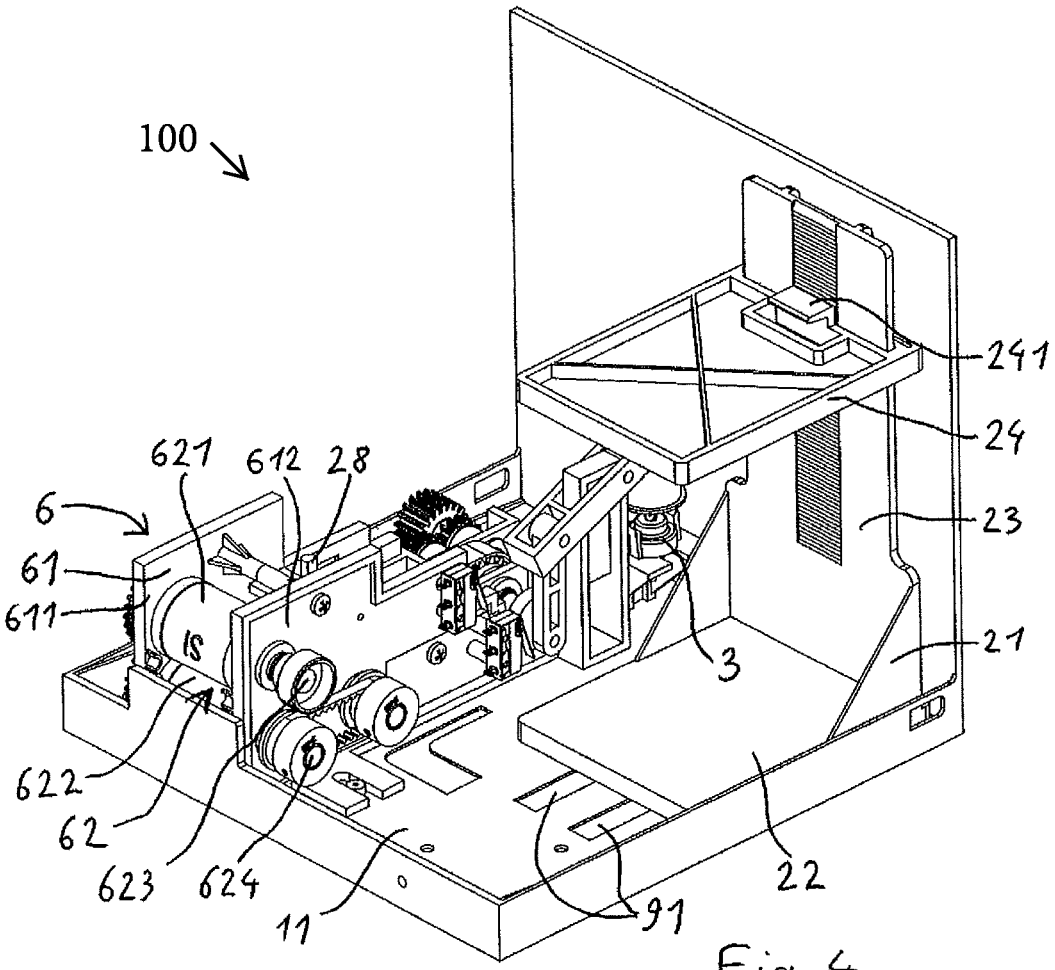
FIG. 4 is a similar view, wherein the small perfume bottle, the stock of strips and the electric control case have been removed.
Figure 5:
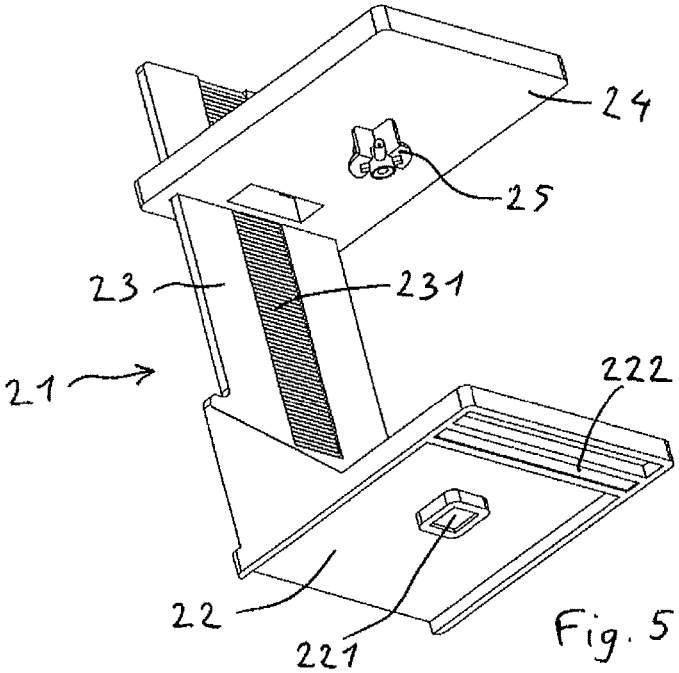
FIG. 5 is a perspective view, from below, of only the small bottle support.
Figure 6:
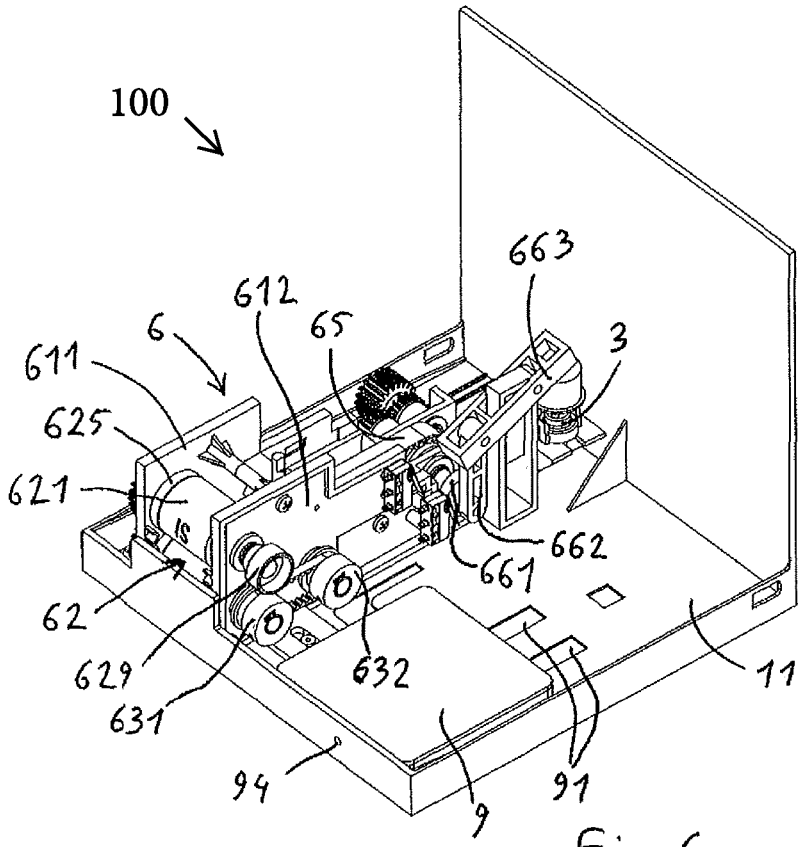
FIG. 6 is a similar view to that in FIG. 4, where the small bottle support has been removed, and the electric control case is repositioned.
Figure 7:
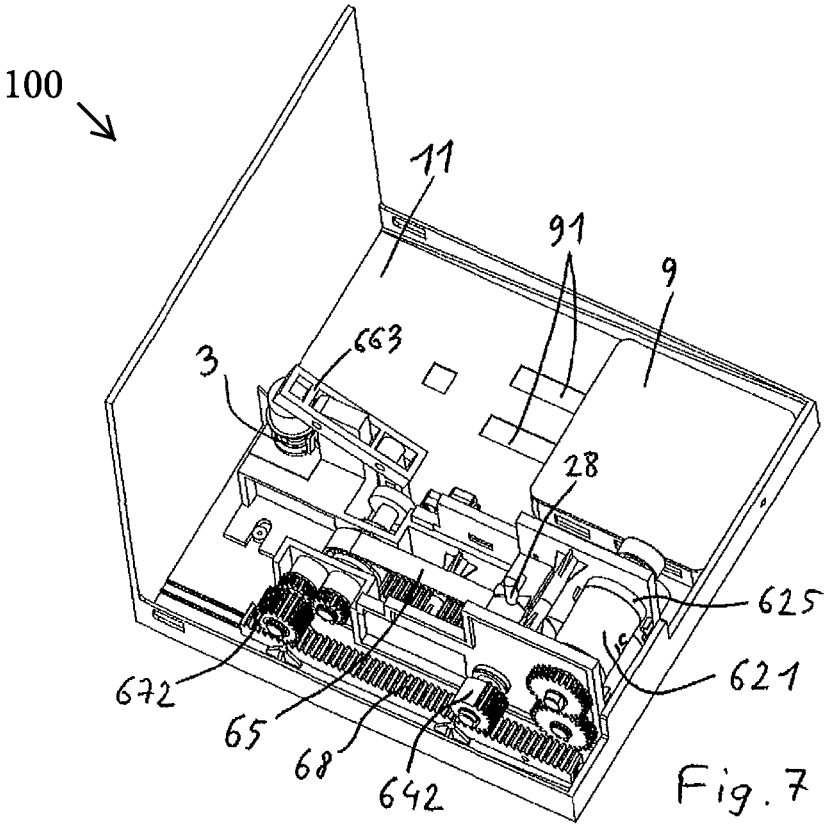
FIG. 7 is a view of the machine in the same state as in FIG. 6, but seen from another angle.
Figure 8:
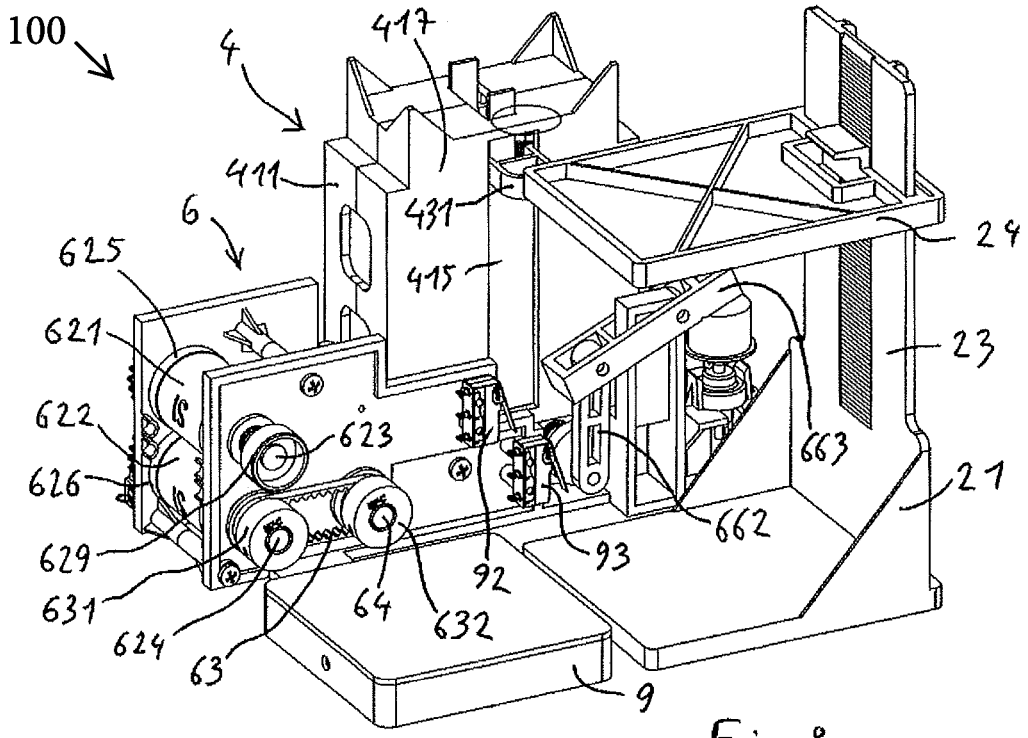
FIG. 8 is a view of the machine, showing all its internal bodies, without the lid or the bottom of the box.
Figure 9:
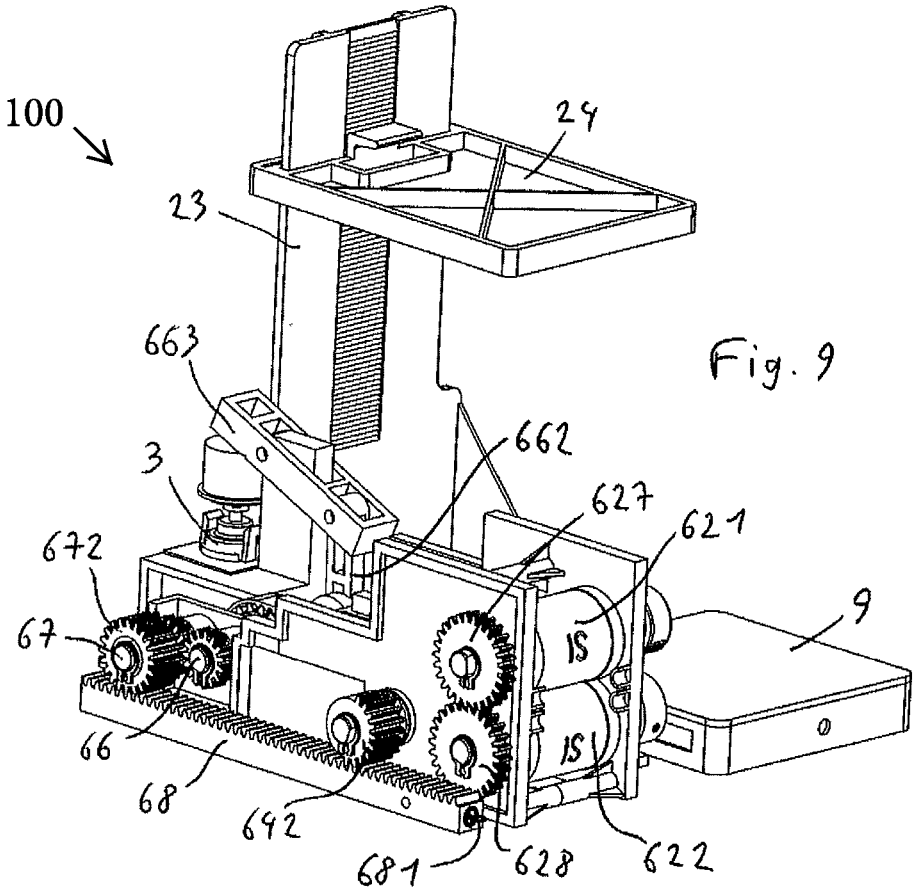
FIG. 9 is another view, from another angle and the stock of strips being removed.
Figure 10:
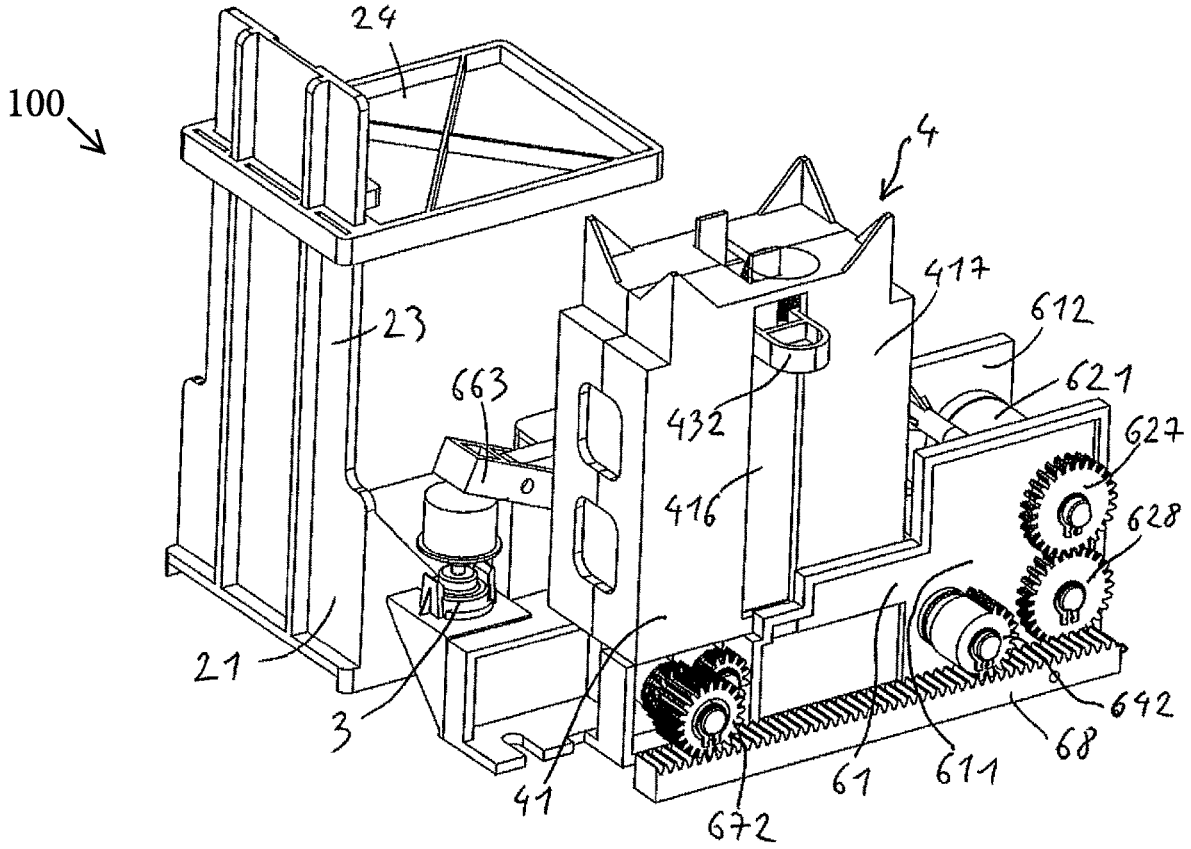
FIG. 10 is a view of the machine in the same state as in FIG. 8, but seen from another angle.

In rest mode, the internal mechanism of the dispenser 100 is found in the location illustrated in FIG. 3, a strip 40*a* being in the grip of the rollers 621, 622 as represented in FIG. 15, its end emerging from the case through the slot 15.

A user can thus grip this strip and pull it to them, according to the arrow F1 in FIG. 15. By friction with the wheels, the traction of the strip drives the pulleys 625, 626 in rotation, which also drives the shafts 623,624 and the embossing rollers 621, 622. The pattern to be printed is located on the rollers, so that it is printed on the section of strip still gripped between the rollers 621, 622 during this traction.

It will be noted that the length of the strips 40 relates to the diameter of the rollers and wheels, substantially equal to or slightly less than their circumference, and to ensure that the traction on the strip 40*a* rotates the wheels and therefore the bottom drive shaft 624 in one half-turn.

Simultaneously, the rotation of the wheels leads to a corresponding rotation:

- of the front transmission shaft 64, by the pulley 631, the belt 63 and the pulley 632, and of the impregnation shaft 66;
- of the impregnation shaft 66, by the pulley 641, the belt 65, and the pulley 651; and
- of the handle 661 assembled on the impregnation shaft 66.

In its movement, the belt 63 drives another strip 40*b* by friction, that is retrieves from the container 4 through the retrieval window 412 and drives towards the printing unit 62, until the front part of this strip 40*b* is located under the spraying nozzle 28, as represented in FIG. 16. Simultaneously, the handle 661 brings about the pivoting of the lever 663 by the intermediary of the crank 662 and actuates the pump 3 which thus sends a small quantity of perfume through the tube 27 up to the spraying nozzle 28 which projects the perfume onto the strip 40*b*.

Simultaneously, the partial sprocket 642 meshes with the rack and moves it towards the back, according to the arrow F2, bringing about the tensioning of the spring 681, as can also be seen in FIG. 16. It will be noted that the sliding of the rack drives the rotation of the rear sprocket 672 by meshing, which freely turns on the secondary shaft 67 because of the free wheel 673. This enables the impregnation shaft 66 to turn in the direction forced by the belt 65, by driving, by the pinion 665, the pinion 671 and the secondary shaft 67 in the opposite direction of the rear sprocket 672.

Having arrived in the position represented in FIG. 16, after a half-turn of all the aforementioned shafts, pulleys and sprockets, and the strip 40*a* being totally retrieved and available for the user, the partial sprocket 642 is found disengaged from the rack, which is thus pulled back towards the front by the spring 681, according to the arrow F3 in FIG. 17. In doing so, the rack drives the rear sprocket 672 in the opposite direction of its rotation in the preceding phase, thus engaging the free wheel 673 and consequently driving the secondary shaft 67 and the impregnation shaft 66. It will be noted that, the impregnation shaft turns in the same direction as in the preceding phase, because of the change in rotating direction brought about by the meshing of the pinions 671, 665. The force exerted by the spring 681 on the rack is thus conveyed by the continued rotating of the impregnation shaft 66 which drives the scrolling of the belt 65, the rotation of the front transmission shaft 64, and the drive shafts 623, 624, and therefore the pulleys 625, 626 and the rollers 621, 622, enabling the strip 40*b* to be inserted between the rollers and start to be driven by the wheels.

Simultaneously, the belt 65 starts to retrieve a new strip 40*c* from the container 4, and the handle continues its rotation to bring about the suction by the pump 3 of a new dose of perfume retrieved from the small bottle 20.

It will be noted that, during this second phase, illustrated by FIG. 17, the partial sprocket 642 is still rotated in the same direction by the transmission shaft 64, but does not interfere with the sliding of the rack in the opposite direction, because there is thus no longer any meshing between the rack 68 and said wheel 642.

In this second phase, after the user has removed the strip 40*a*, the dispensing mechanism thus functions autonomously, only by the energy stored by the spring 681 during the first phase. All the dispensing mechanisms therefore require no external energy source, the only energy necessary for these mechanisms being in fact supplied by the user when they retrieve the strip from the dispenser 100.

At the end of the second phase, the spring 681 has brought the rack into its initial position, and all the mobile elements are found in the location in FIG. 15, the new strip 40*b* thus being ready to be gripped by a user.

It will again be noted that, during its rotation, the handle 661 will have caused a press on the contactor 93, thus sending a signal to count the number of uses to the electric case's calculator.

The invention is not limited to the embodiment which has been defined above, only as an example. In particular, the system of sprockets, partial to ensure the disconnection between the wheel 642 and the rack 68 during the second functioning phase could be replaced by any other disengageable connecting means enabling the disengagement of the front transmission shaft 64 from the rack when it arrives at the end of the run towards the rear 10 and during the second functioning phase.

Also, while keeping the strip retrieval device outside of the container, the spraying device and the marking rollers, an electric motor could be provided to drive these systems. The elevated printing by embossing could also be replaced by other printing methods. Lighting or holographic means can also be used, in particular, to complement the presentation of the product in the window and, to this end, provide a cable passage, for an electrical supply cable, in the bottom wall of the case.

The invention claimed is:

1. A dispensing machine for dispensing a support impregnated by an odour, comprising:

a container for storing the support, a dispensing mechanism for retrieving the support from the container and dispensing the support to a person, a vial support configured to receive a perfume vial containing a perfume with an emanating odour, and an impregnation means for impregnating the support with the emanating odour to provide an odour-impregnated support, wherein the support is suitable to be impregnated by the odour, the support comprising a plurality of individual strips;

wherein the dispensing mechanism comprises a marking unit adapted to mark the odour-impregnated support so the person can identify the odour impregnated on the support;

wherein the dispensing mechanism comprises drive pulleys arranged to be driven by the support and which are connected to a drive mechanism arranged to bring the support up into the marking rollers, wherein the drive mechanism comprises:

transportation bodies arranged to retrieve the support by friction and to transport the support to the marking unit, an alternative drive mechanism to drive the transportation bodies alternatively:

in a first phase, by the drive pulleys when these are rotated by the retrieval of the support, in a second phase, by an energy storage arranged to store energy during the first phase;

wherein the energy storage comprises a spring acting on a rack meshing with sprockets connected to the transportation bodies in a temporarily separable way; and wherein the impregnation means is adapted to be actuated automatically.

2. Dispensing machine according to claim 1, wherein the marking unit comprises an embossing means for embossing an elevated mark on the odour-impregnated support.

3. Dispensing machine according to claim 2, wherein the marking unit comprises a set of two marking rollers between which the odour-impregnated support passes through during the dispensing of the support to the person.

4. Dispensing machine according to claim 1, wherein the vial support configured to receive the perfume vial, and the impregnation means comprises a pump connected to the perfume vial and to a spraying nozzle located over the support at a position between the support storage container and the marking unit.

5. Dispensing machine according to claim 4, wherein the pump is actuated by a lever connected to the dispensing mechanism.

6. Dispensing machine according to claim 4, further comprising a control case connected to sensors adapted to detect a need to replace the perfume vial, to count the actuation number of the impregnation means and for detecting the presence of the support in the support storage container, wherein the control case comprises a indicator.

7. Dispensing machine according to claim 6, wherein the sensor adapted to detect the replacement of the perfume vial comprises electric contact means held by the vial support and connected to the control case.

8. Dispensing machine according to claim 4, wherein the pump is connected to the perfume vial via a first tube, and to the spraying nozzle via a second tube.

9. Dispensing machine according to claim 1, wherein the drive pulleys are connected in rotation to the marking rollers.

10. Dispensing machine according to claim 1, wherein the support storage container comprises a container body closed on a bottom wall, a front wall, and a pressure plate, wherein the pressure plate inside the container that is adapted to be press the support toward the bottom wall by one or more springs.

11. Dispensing machine according to claim 1, wherein the support storage container is configured to store 200 individual strips, each having a format of 82 mm by 28 mm.

12. Dispensing machine according to claim 1, wherein the marking unit is a printing unit comprising ink.

13. A dispensing machine for dispensing a support impregnated by an odour, comprising:

a container for storing the support, a dispensing mechanism for retrieving the support from the container and dispensing the support to a person, a vial support configured to receive a perfume vial containing a perfume with an emanating odour, and an impregnation means for impregnating the support with the emanating odour to provide an odour-impregnated support, wherein the support is suitable to be impregnated by the odour, the support comprising a plurality of individual strips;

wherein the dispensing mechanism comprises a marking unit adapted to mark the odour-impregnated support so the person can identify the odour impregnated on the support;

wherein the marking unit comprises an embossing means for embossing an elevated mark on the odour-impregnated support;

wherein the dispensing mechanism comprises drive pulleys arranged to be driven by the support and which are connected to a drive mechanism arranged to bring the support up into the marking rollers, wherein the drive mechanism comprises:

transportation bodies arranged to retrieve the support by friction and to transport the support to the marking unit, an alternative drive mechanism to drive the transportation bodies alternatively:

in a first phase, by the drive pulleys when these are rotated by the retrieval of the support, in a second phase, by an energy storage arranged to store energy during the first phase;

wherein the energy storage comprises a spring acting on a rack meshing with sprockets connected to the transportation bodies in a temporarily separable way; and wherein the drive mechanism comprises an energy storage comprising a spring acting on a rack meshing with sprockets.

14. Dispensing machine according to claim 13, wherein the drive pulley is driven by the support when the support is retrieved by the person.

15. Dispensing machine according to claim 13, wherein the machine does not require an external energy source or a mechanical control means.

* * * * *